US006002319A

United States Patent [19]

Honma

[11] Patent Number: 6,002,319

[45] Date of Patent: Dec. 14, 1999

[54] INDUCTANCE DEVICE WITH GAP

[75] Inventor: Tooru Honma, Chiba, Japan

[73] Assignee: TDK Corporation, Tokyo, Japan

[21] Appl. No.: 09/144,987

[22] Filed: Sep. 1, 1998

[30] Foreign Application Priority Data

Sep. 4, 1997 [JP] Japan ..... 9-239520
Mar. 24, 1998 [JP] Japan ..... 10-075368

[51] Int. Cl.[6] ..... H01F 27/29; H01F 27/30

[52] U.S. Cl. ..... 336/73; 336/178; 336/192; 336/198

[58] Field of Search ..... 336/73, 165, 178, 336/198, 208, 192

[56] References Cited

U.S. PATENT DOCUMENTS 2,463,778 3/1949 Kellogg ..... 336/73
2,859,337 11/1958 Rietveld ..... 336/73
3,768,055 10/1973 Oliver ..... 336/73

*Primary Examiner*—Thomas J. Kozma
*Attorney, Agent, or Firm*—Oblon, Spivak, McClelland, Maier & Neustadt, P.C.

[57] ABSTRACT

An inductance device comprises: an EE type ferrite core with an air gap at a center leg portion; a bobbin having at least three chambers wound by coils, said ferrite core being placed on said bobbin; and a shield coil formed by a first part and a second part of the coil, in which the first part is wound a chamber surrounding a peripheral portion of the air gap and the second part is wound the chamber in a reverse direction of the first part, the ends of the shield coil being short-circuited. In the inductance device with gap, the first and second parts of the coil are wound in the chamber surrounding the peripheral portion of the air gap in opposite direction each other, and the ends of the coil are shorted circuited. Thus, it is formed the shield coil for a leak magnetic flux from the air gap containing a component perpendicular to the main magnetic flux.

11 Claims, 10 Drawing Sheets

FIG.6
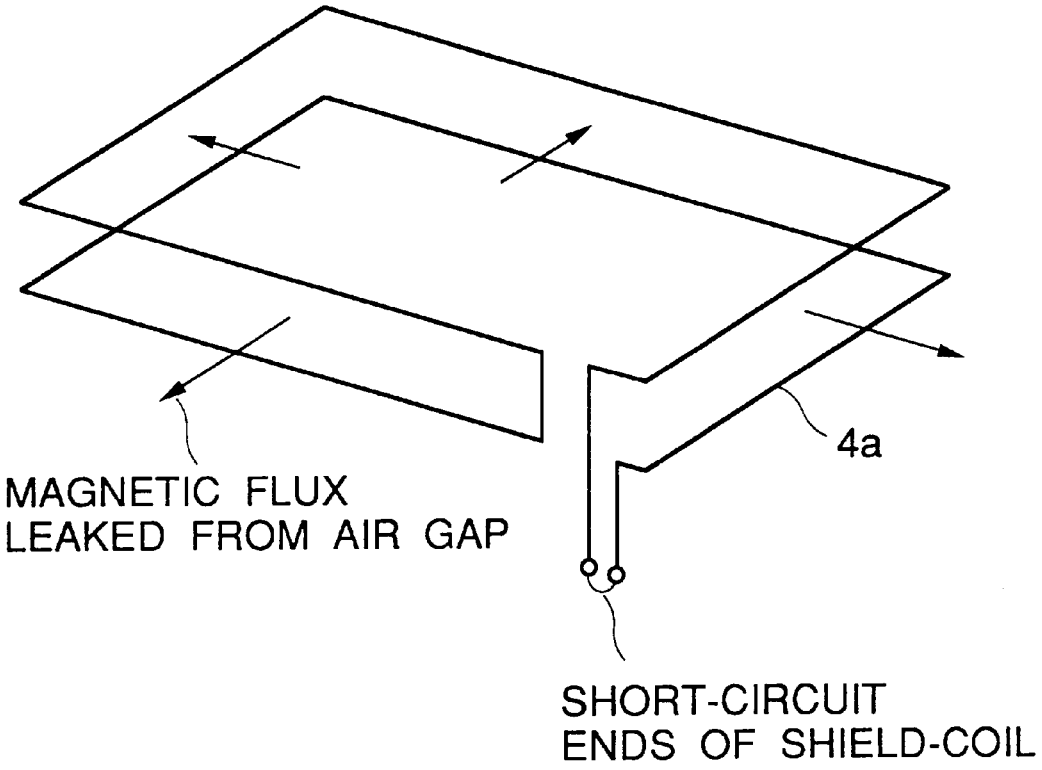
PRIOR ART FIG.7
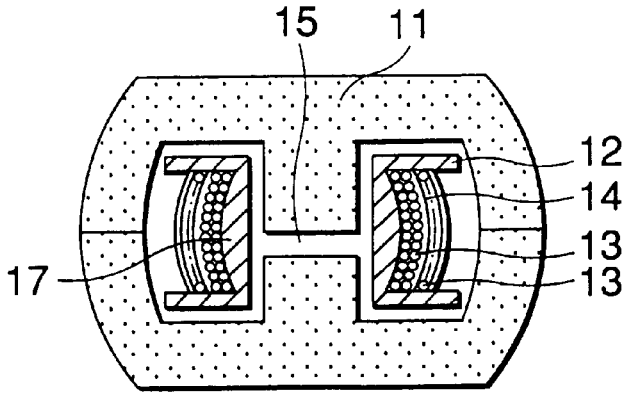

PRIOR ART FIG.8
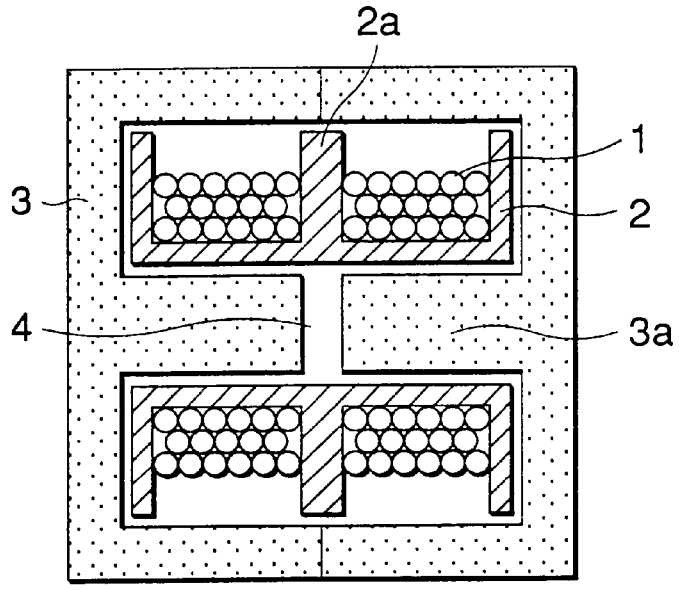
PRIOR ART FIG.9
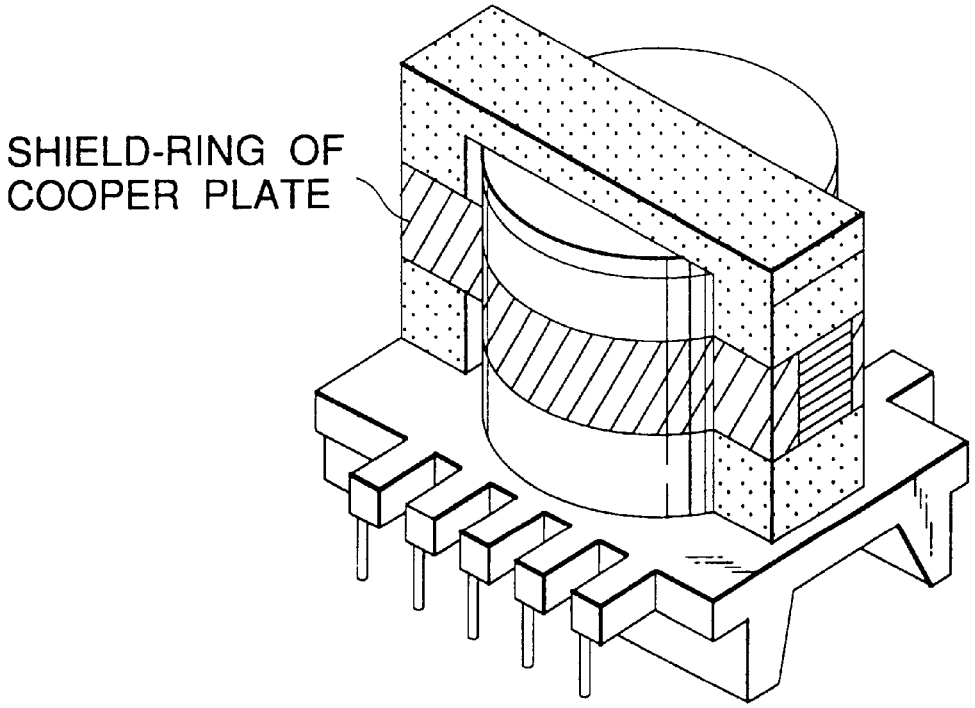

INDUCTANCE DEVICE WITH GAP

BACKGROUND OF THE INVENTION

The present invention relates to a transformer with a gap for switching power supply used in a switching regulator and an inductor with a gap, and more particularly to the transformer and the inductor which use divided bobbins.

Various transformers for switching power supply and inductors have been known. In those transformer and inductors, a measure has been taken for adjusting an inductance and preventing a magnetic saturation of the core. In the case of the EE type core, an air gap is formed at the abutting portion of the center leg of the core. When the transformer and inductor are operated, a magnetic flux leaks through the gap and couples with the coil located near the gap. The leaking magnetic flux causes an eddy current in the coil to heat the coil and possibly interferes with components located outside the transformer. Some measures to reduce the heat generated in the coil by the eddy current loss have been proposed. As shown in FIG. 7, a technique to locate the coil apart from the air gap 15 is proposed in Unexamined Japanese Patent Publication 2-44704. As shown in FIG. 8, a technique to eliminate the coil at a location near the air gap by providing a protruded portion at the location near the coil is proposed in Unexamined Japanese Patent Publication 7-302720. To shield the leaking magnetic flux, the outer peripheral surface of the core is usually covered with a shield ring of a copper plate as shown in FIG. 9. In some devices, a wire is used in place of the copper plate for the same purpose (Japanese Utility Model Nos. 2518250 (FIG. 10A) and 2518241 (FIG. 10B)).

Problems of the prior devices described above will be described.

The automization of the manufacturing of the transformer and the inductor is generally realized. In the manufacturing method in which the shield ring of a copper plate is provided on the side walls of the transformer or the inductor as shown in FIG. 9, the mounting and soldering by manual still occupy a major part of the manufacturing work. Such manual work requires a number of steps for its manufacturing, and hinders simplification and automization of the manufacturing process.

According to FIG. 7 (Unexamined Japanese Patent Publication 2-44704), the whole coil and the core are excessively large in size since the thick bobbin is used, and the coil is put on the thick bobbin.

According to FIG. 8 (Unexamined Japanese Patent Publication 7-302720), the protruded portion is provided at the location near the coil, and no coil is present at a location near the air gap. Therefore, the eddy current loss by the leaking magnetic flux is extremely reduced, but the magnetic flux leaked through the air gap propagates into the air to interfere with other components. To avoid the interference by the leaking magnetic flux, it is necessary to entirely cover the core with an additional shielding means, for example, a copper plate as shown in FIG. 9.

In the case of FIG. 10A, the chamber is provided around the upper collar portion 70 of the bobbin, and the shield coil 74 of a wire is wound therearound. That is, the wire shield coil 74 is used in place of the copper plate shield ring. The winding beginning and ending ends of the shield coil are connected to the terminal 71 buried in the upper collar portion 70 of the bobbin in a shortcircuiting manner. To this connection, soldering is required for the terminal 71. Therefore, to complete the transformer, two steps of soldering are exercised, one for the connection of the terminal 71 and the other for the connection of the terminal 79 located on the side opposite to the side having the terminal 71 located. This leads to increase of the number of manufacturing steps. In the transformer of FIG. 10B, the shield coil 84 is formed like a short ring by use of a wire, the core and the bobbin are combined, and the shield coil is attached to on two shield coil receiving portions 81 provided on the upper collar portion 80 of the bobbin. Therefore, the fixing of the shield coil 84 is instable.

Further, the step of manufacturing the shield coil is additionally provided. The shielding method by use of the wire is effective in shielding the magnetic flux component of the transformer or the inductor which develops in parallel with the main magnetic flux, but is ineffective for the magnetic flux component perpendicular to the main magnetic flux and the magnetic flux leaking through the air gap.

SUMMARY OF THE INVENTION

Accordingly, an object of the present invention is to provide an inductance device with an air gap which reduces the heat of the coil generated by the eddy current loss and the magnetic interference with components located outside the transformer.

According to the invention, an inductance device comprises: an EE type ferrite core with an air gap at a center leg portion; a bobbin having at least three chambers wound by coils, said ferrite core being placed on said bobbin; and a shield coil formed by a first part and a second part of the coil, in which the first part is wound a chamber surrounding a peripheral portion of the air gap and the second part is wound the chamber in a reverse direction of the first part, the ends of the shield coil being short-circuited.

In the inductance device with gap according to the invention, the first and second parts of the coil are wound in the chamber surrounding the peripheral portion of the air gap in opposite direction each other, and the ends of the coil are shorted circuited. Thus, it is formed the shield coil for a leak magnetic flux from the air gap containing a component perpendicular to the main magnetic flux.

BRIEF DESCRIPTION OF THE PREFERRED EMBODIMENTS

FIG. 6 is a diagram for explaining the principle of a first shield coil in the transformer;

FIG. 7 is a diagram for explaining a conventional first method for reducing an eddy current loss.

FIG. 8 is a diagram for explaining a conventional second method for reducing an eddy current loss.

FIG. 9 is a diagram for explaining a conventional transformer using a shield ring formed with a copper plate;

DETAILED DESCRIPTION OF THE PREFERRED EMBODIMENTS

First Embodiment

The preferred embodiment of the present invention will be described with reference to FIGS. 11 through 15.

Figure 11:
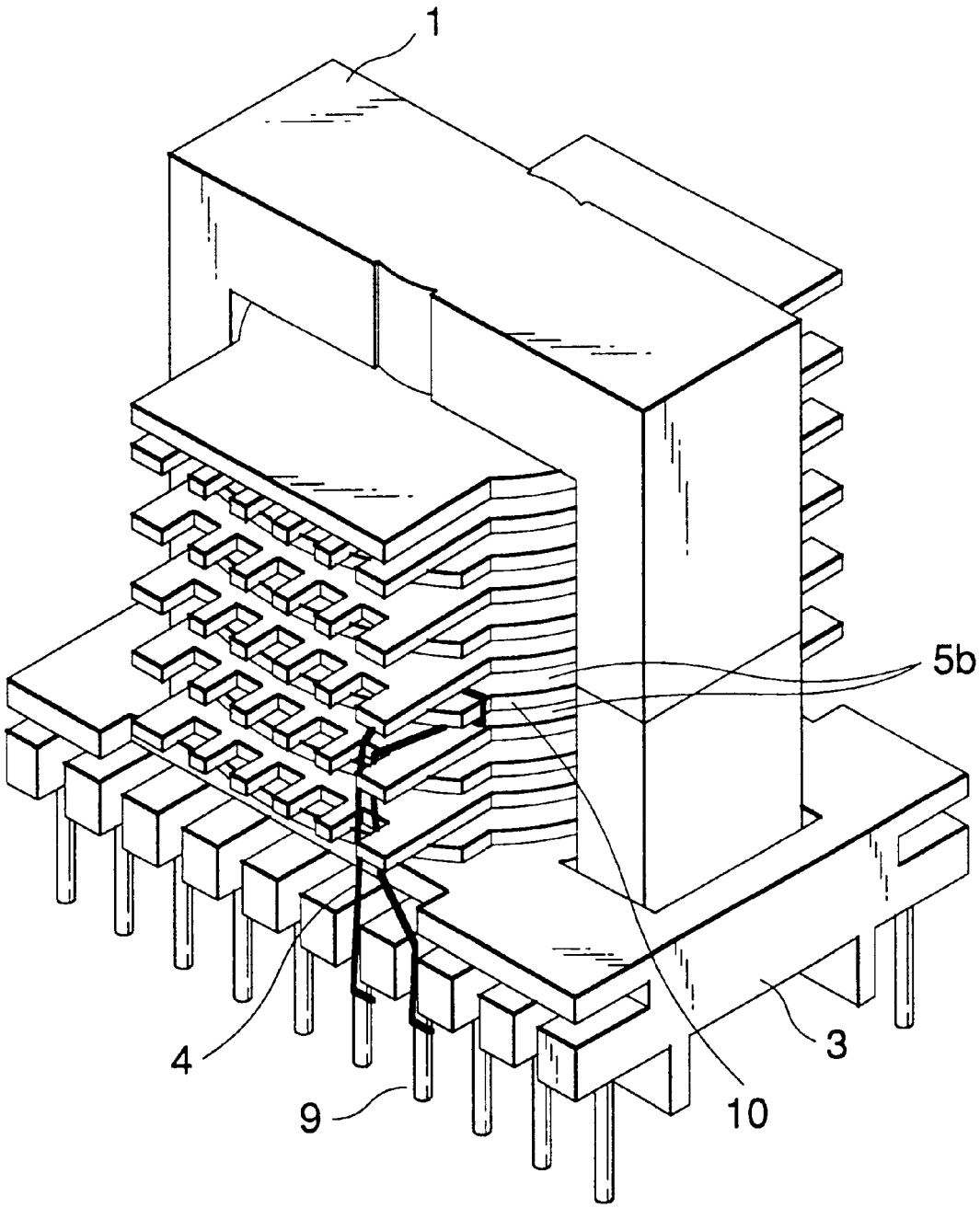
FIG. 11 is a perspective view showing a transformer constructed according to the present invention.
Figure 12:
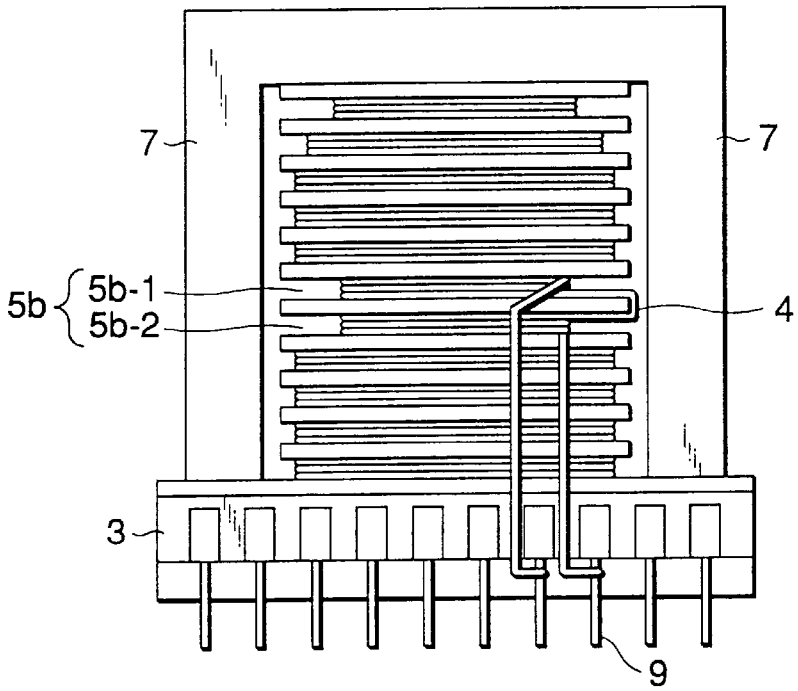
FIG. 12 is a front view showing the transformer shown in FIG. 11.
Figure 13:
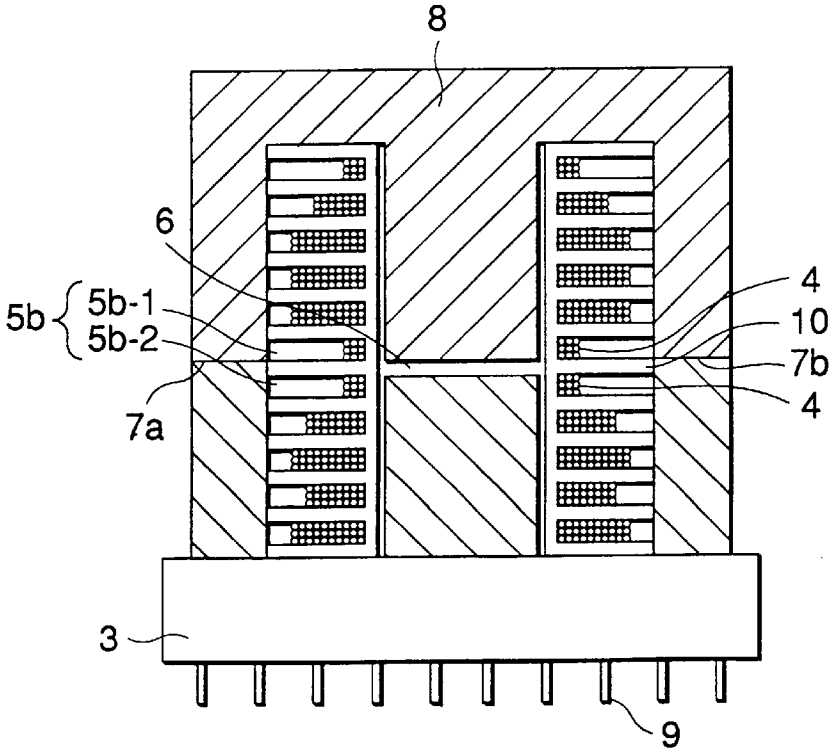
FIG. 13 is a cross sectional view of the transformer when viewed from the front.
Figure 14:
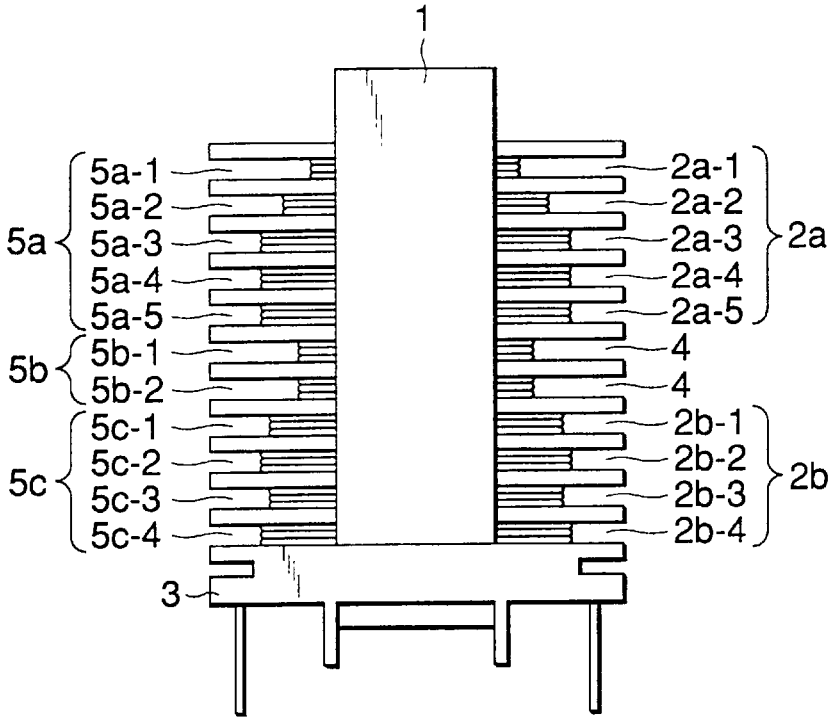
FIG. 14 is a side view showing the transformer shown in FIG. 11.
Figure 15:
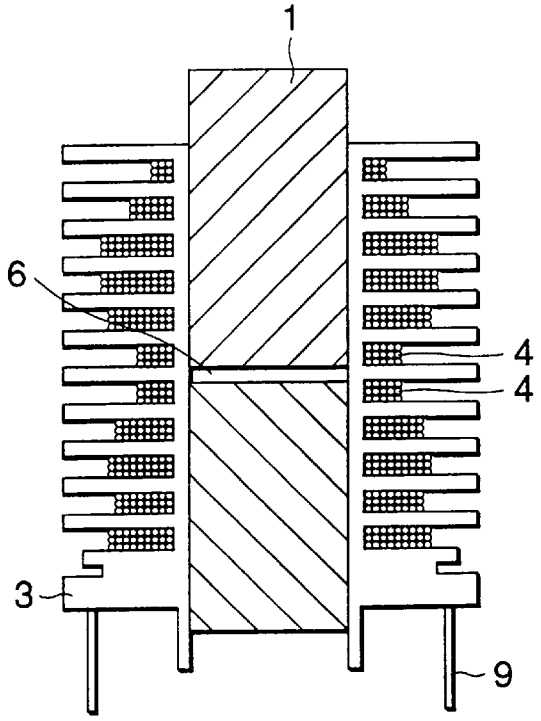
FIG. 15 is a cross sectional view of the transformer when viewed from the side.

FIG. 11 is a perspective view showing a transformer for the switching power supply constructed according to the present invention. In the figure, reference numeral 1 is a ferrite core; 3 is a bobbin; and 5*b* is a chamber which is located substantially at the central portion of the ferrite core 1 and covers an air gap of the core. The chamber 5*b* is divided, by a collar or expanded portion 10, into two subchambers, a first subchamber and a second subchamber. Those subchamber are wound by a shield coil 4 and the ends of the shield coil are connected to bobbin terminals 9. As shown in FIG. 12 showing a front view of the transformer, the shield coil 4 is wound on the first and second subchamber 5*b*-1 and 5*b*-2. The ends of the shield coil 4 are connected to the bobbin terminals 9. FIG. 13 is a cross sectional view showing the transformer when viewed from the front, and FIG. 14 is a side view of the transformer.

Figure 5:
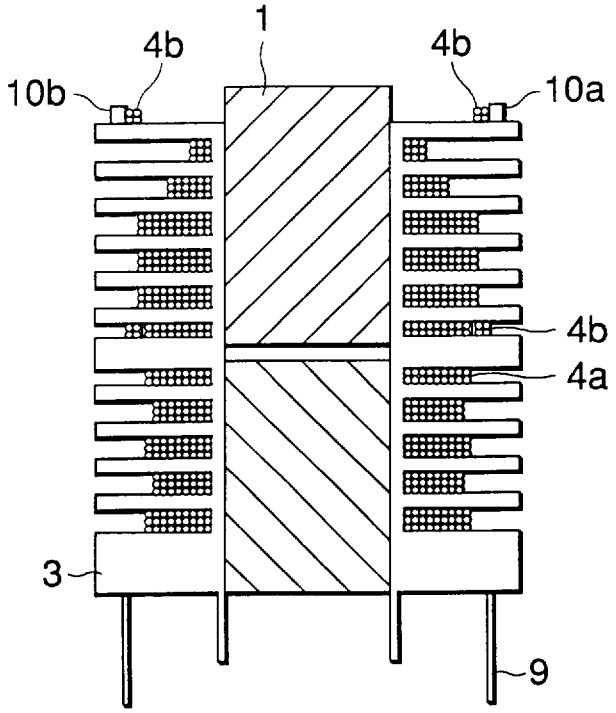
FIG. 5 is a cross sectional view of the transformer when viewed from the side.
Figure 10A:
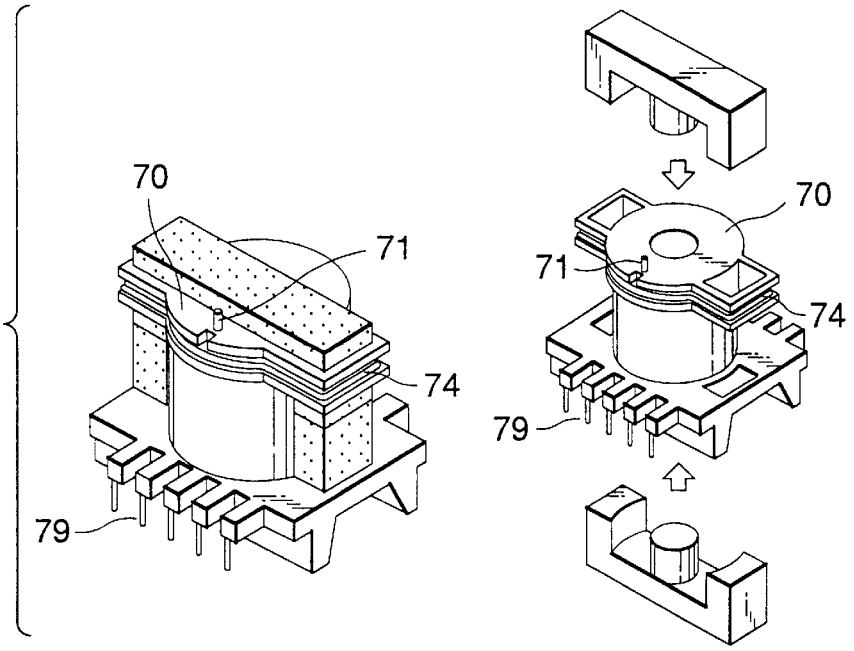
PRIOR ART FIG.10A
FIG. 10A is a diagram showing a first conventional shield ring formed by using a wire.
Figure 10B:
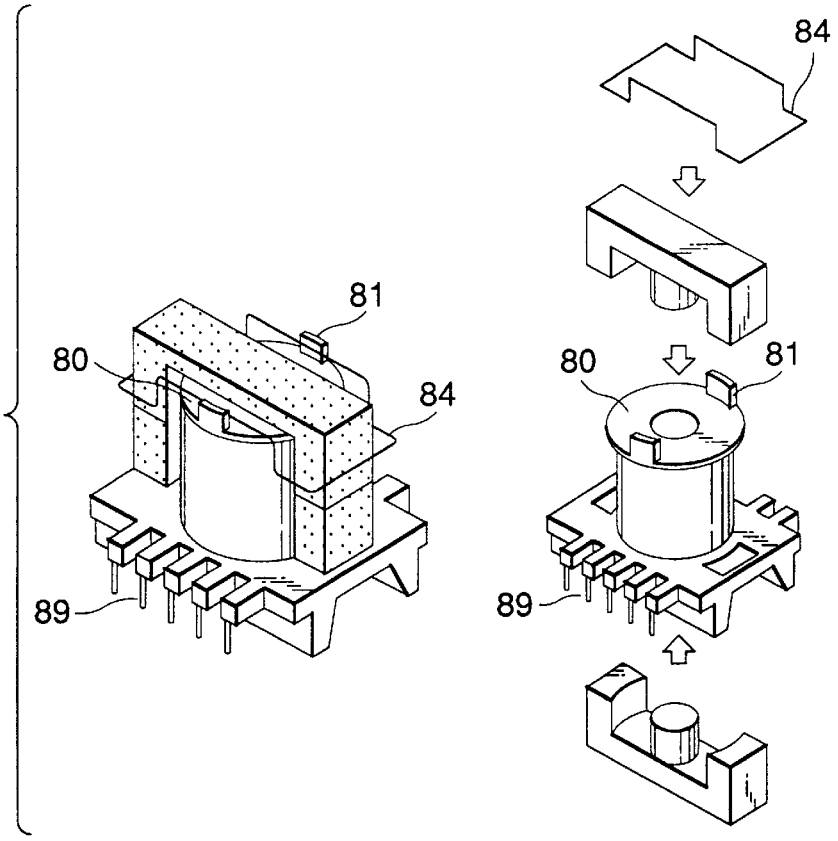
PRIOR ART FIG.10B
FIG. 10B is a diagram showing a second conventional shield ring formed by using a wire.

In the transformer, the collars are provided on the top and bottom ends of the bobbin 3. A total of eleven chambers 5*a*-1 to 5*a*-5, 5*b*-1 and 5*b*-2, and 5*c*-1 to 5*c*-4 are located between those collars. The center leg 8 of the core includes an air gap 6 (not shown) located substantially at the mid position. Thus, the ferrite core 1 of the EE type is centrally placed on the bobbin 3. The first and second subchambers 5*b*-1 and 5*b*-2, located substantially at the middle of the bobbin 3, are wound by the shield coil. 4; the winding subchambers above the subchambers 5*b*-1 and 5*b*-2 are wound by the primary auxiliary coil 2*a*-1, secondary coil 2*a*-2, primary main coil 2*a*-3, secondary coil 2*a*-4 and primary main coil 2*a*-5; the winding subchambers below the subchambers 5*b*-1 and 5*b*-2 are wound by the secondary coil 2*b*-1, primary main coil 2*b*-2, secondary coil 2*b*-3 and primary main coil 2*b*-4. The coils are first wound on the subchamber 5*c*-4 closer to the bobbin terminals 9, and on the subsequent ones in successive order. The shield coil 4 is wound on the second subchamber 5*b*-2, which is located substantially at the middle, by the number of turns substantially the half of the total number of turns of the shield coil 4. The shield coil 4 is also wound on the first subchamber 5*b*-1 by the remaining number of turns in the winding direction opposite to that in which the shield coil 4 is wound on the second subchamber 5*b*-2. Thereafter, the remaining coils are all wound. The ends of those wound coils are led to the bobbin terminals 9 and soldered thereto by one step of soldering. FIG. 5 shows a cross sectional view of the transformer when viewed from the side. The shield coil 4, which is essential to the present invention, as well as other coils of the transformer may be wound in a series of manufacturing steps and soldered by one step of soldering. Therefore, the manufacturing process of the transformer is more simplified than that of the conventional transformer using the shield ring of the copper plate as shown in FIG. 9. While the present invention has been described by use of the transformer, the invention may be applied to other devices and components having great change of magnetic flux, e.g., an inductor for active filter.

Figure 16:
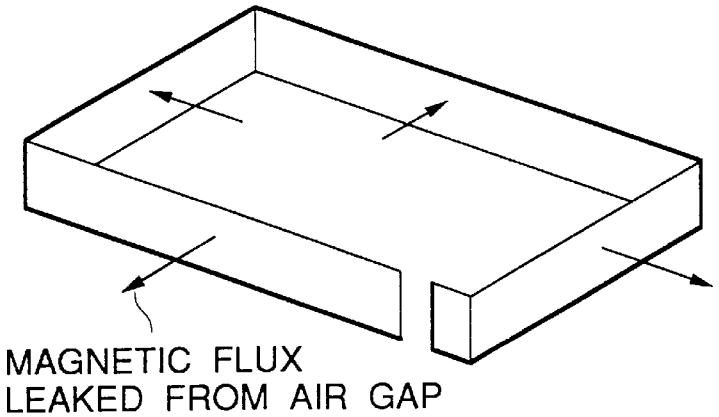
FIG. 16 is a diagram useful in explaining the principle of a shield coil in the transformer.
Figure 17:
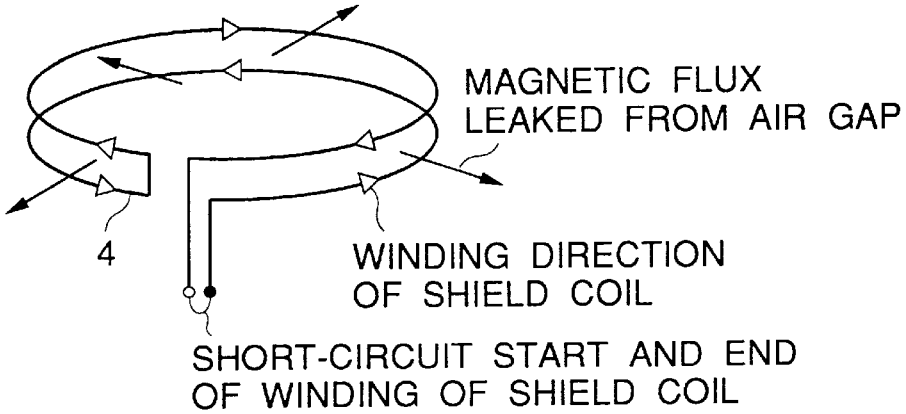
FIG. 17 is a diagram for explaining a shield coil consisting one coil.
Figure 18:
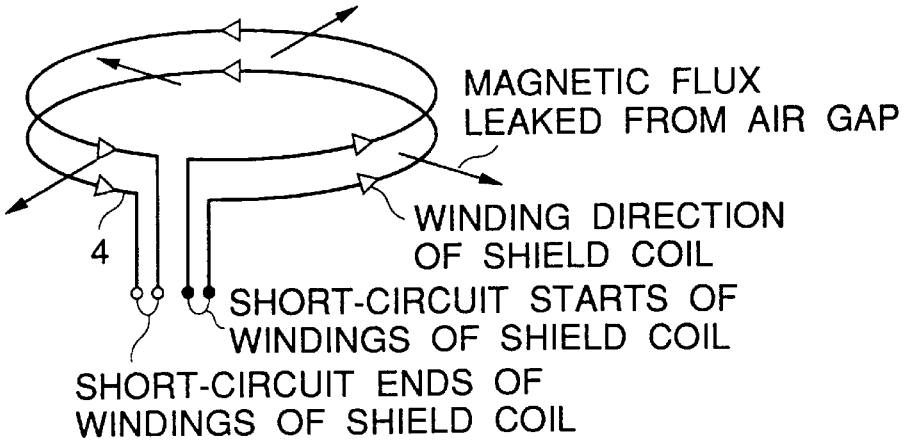
FIG. 18 is a diagram for explaining a shield coil consisting two coils.

The operation of the thus constructed transformer will be described with reference to FIGS. 16 to 18.

When the above-mentioned transformer for the switching power supply is applied to a switching regulator, the leaking magnetic flux couples with the coil located near the center-leg air gap to cause an eddy current therein in the conventional transformer. In this connection, in the transformer of the invention, the shield coil of several turns, not the main coil, are present at the location near the center-leg air gap. Therefore, the eddy current loss by the leak magnetic flux from the center-leg air gap, viz., the heat by the eddy current loss, is considerably reduced, and it little affects the temperature rise of the whole transformer. For the magnetic interference, a shield coil 4 is constructed as shown in FIG. 17 so as to operate according to the shield effect principle of a shield ring of a copper plate (FIG. 16). In other words, the invention substitutes the shield coil 4 (FIG. 17) for the shield ring formed by the copper plate (FIG. 16). An embodiment of the invention shown in FIG. 18 uses two shield coils arranged in parallel to each other so as to satisfy the FIG. 16 shield ring principle. Those coils are connected such that the voltages induced in the coils are substantially equal in amplitude but opposite in polarity. Therefore, little currents flow through the coils, and therefore the heat generated is negligible. The shield coils, and the coils are wound in the bobbin through a series of steps, and connected to the bobbin terminals by one step of soldering. In other words, there is eliminated the shield mounting steps, which are essential steps in the conventional transformer, whereby the manufacturing process of the transformer is simplified.

Data for evaluating the shielding function of the thus constructed transformer actually installed will be given below.

Induction voltages of search coils with the shield coils and no shield coils were measured.

TABLE (1)

Comparison of voltages induced in the search coils

| | Shield Coil 4 Not used | Shield Coil 4 Used |
|---|---|---|
| Induction voltage (mV) | 64 | 50 (Approx. 22% Reduction) |

TABLE (2)

Conditions of the above measurements

| Switching power supply output | 130 W |
|---|---|
| Circuit | Flyback |
| Ferrite core type | EER 40 |

TABLE (2)-continued

| Conditions of the above measurements | |
|---|---|
| Switching power supply output | 130 W |
| Center-leg air gap | 1.22 mm |
| Shield chamber width | 4 mm |
| Shield coil diameter | 0.35 mm |

The data presented above clearly shows the following facts: provision of the shield coils at a location near the air gap reduces the magnetic interference by the leak magnetic flux outside the transformer by about 20%. Further, the shield coil as well as other coils are wound through a series of winding steps and soldered to the related terminals by one step of soldering. Therefore, there is no need of mounting the copper plate or the short ring of wire by manual. The result is simplification of the manufacturing process of transformers and inductors. The shield coils are wound in the bobbin into a unit form, the fixing of the shield coils is stable.

Second Embodiment

Figure 1:
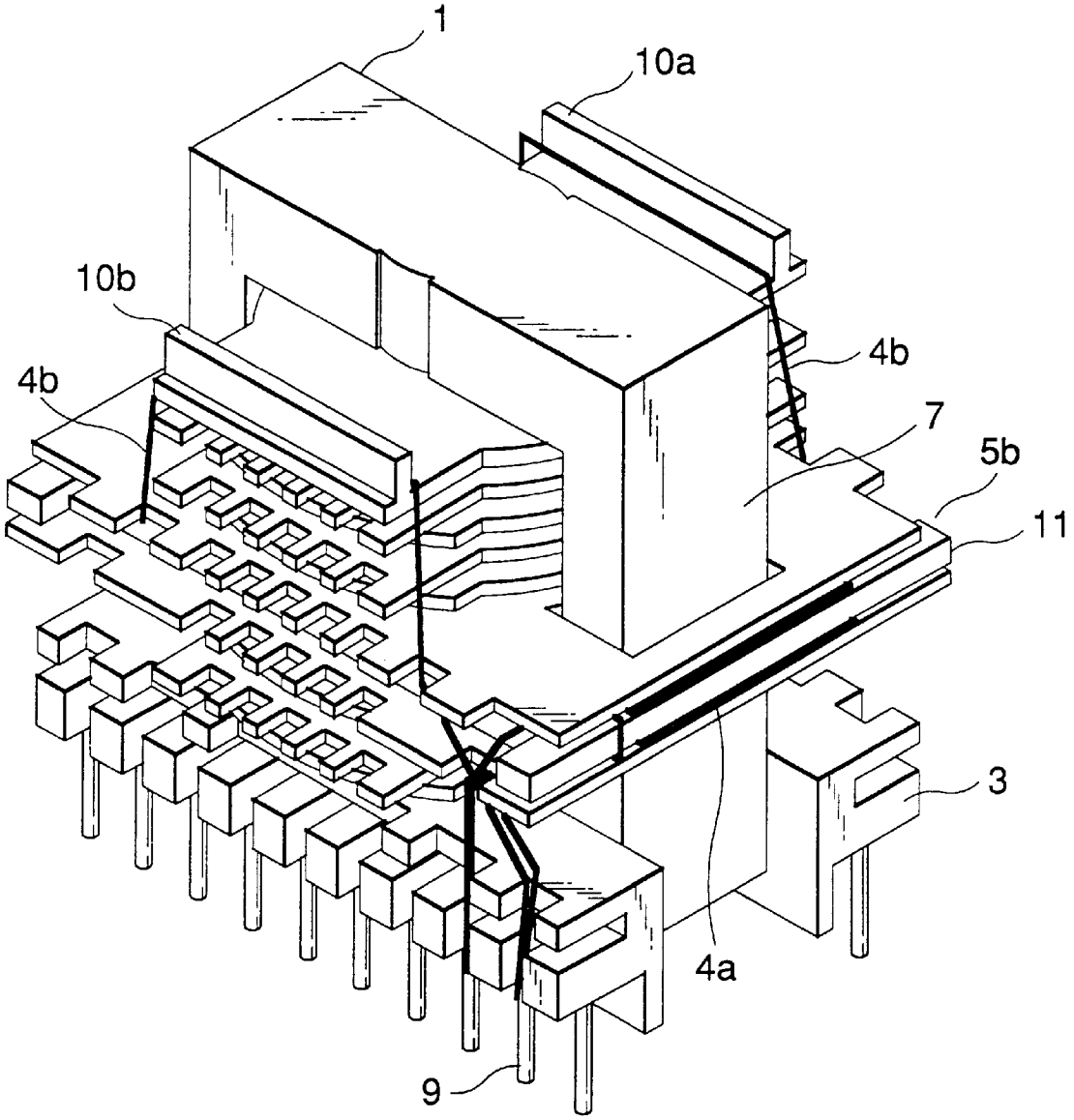
FIG. 1 is a perspective view showing a transformer constructed according to the present invention.

FIG. 1 is a perspective view showing a transformer for the switching power supply constructed according to the present invention. In the figure, reference numeral 1 is a ferrite core; 3 is a bobbin; and 5*b* is a chamber which is located substantially at the central portion of the ferrite core 1, and covers an air gap of the core. The chamber 5*b* has two holes for receiving outer legs 7 of the ferrite core or through which the outer legs are inserted. The chamber 5*b* is divided, by a collar or expanded portion 11, into two subchambers, a first subchamber and a second subchamber. The first subchamber of the chamber 5*b* is wound by a first shield coil 4*a*. A second shield coil 4*b* is wound around the second subchamber and collar ridge portions 10*a* and 10*b* as the upper portions of the bobbin. Those shield coils are connected to bobbin terminals 9.

Figure 2:
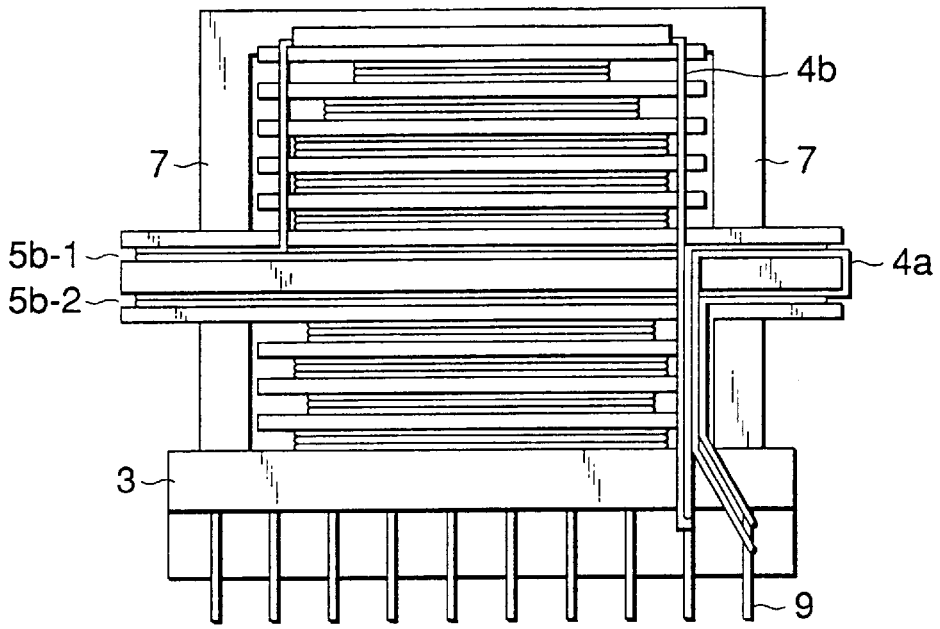
FIG. 2 is a front view showing the transformer shown in FIG. 1.
Figure 3:
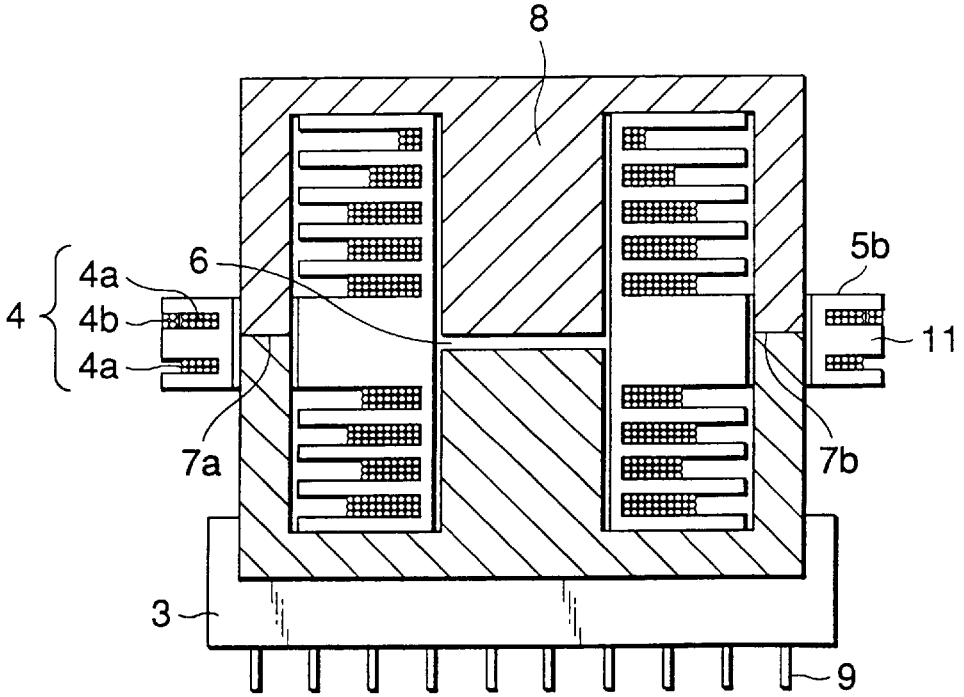
FIG. 3 is a cross sectional view of the transformer when viewed from the front.
Figure 4:
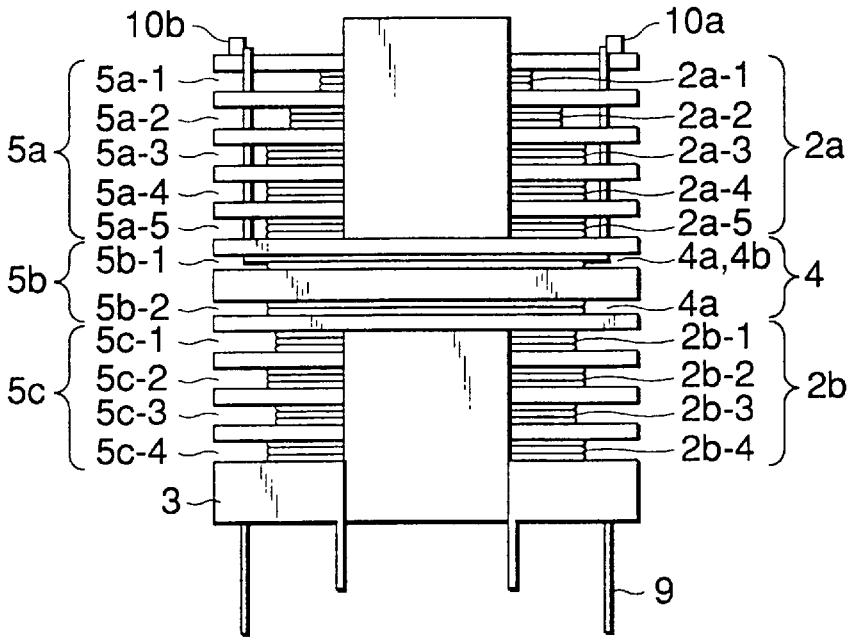
FIG. 4 is a side view showing the transformer shown in FIG. 1.

The details of the transformer is shown in FIGS. 2 to 5. FIG. 2 is a front view of the transformer, and FIG. 4 is a side view of the same, and FIGS. 3 and 5 are cross sectional views of the transformer when viewed from the front and side. In FIG. 4, reference numeral 1 is a ferrite core; 3 is a bobbin; and 5*a*, 5*b* and Sc are chambers. Of those chambers, the chambers 5*a* and 5*c* are wound by given coils 2*a* and 2*b*, respectively, and connected to the bobbin terminals 9. In FIG. 3, numeral 6 is a center-leg air gap; 7*a* and 7*b* are abutting portions of the outer legs 7; and 8 is a center leg of the ferrite core. The chamber 5*b* located near the center-leg air gap 6 is divided, by the collar or expanded portion 11, into two subchambers 5*b*-1 and 5*b*-2. Those subchambers are wound by shield coils , which reduce the effects of the magnetic flux leaking through the air gap of the core and further has a shielding effect of the transformer. The shield coils 4 are a first shield coil 4*a* and a second shield coil 4*b*. The first shield coil 4*a* is wound on both the first and second subchambers 5*b*-1 and 5*b*-2. In this case, the number of turns of the first shield coil 4*a* on the first subchambers 5*b*-1 is substantially equal to the shield coil 4*a* on the second subchamber 5*b*-2, but the turning direction of the shield coil 4*a* on the first subchamber 5*b*-1 is opposite to that of the shield coil 4*a* on the second subchamber 5*b*-2. The winding beginning end and the winding ending end of the first shield coil 4*a* are connected to the bobbin terminals 9. The second shield coil 4*b* is wound on the collar ridge portions 10*a* and 10*b* and in the first subchamber 5*b*-1 in a state that portions of the second shield coil 4*b* are perpendicular to the coil 2*a*, and, like the first shield coil 4*a*, is connected to the bobbin terminals 9. The winding beginning and ending ends of the first and second shield coils 4*a* and 4*b* are short-circuited to each other.

The first shield coil 4*a* may also be used as described below.

The first shield coil 4*a* is divided into two coils of substantially equal number of turns, a first coil and a second coil. The first coil is wound on the second subchamber 5*b*-2, and the winding beginning and ending ends of the first coil are connected to the bobbin terminals 9 of the bobbin 3. Then, the second coil is wound on the second subchamber 5*b*-2 and the winding beginning and ending ends of the first coil are connected to the bobbin terminals 9 of the bobbin 3. The winding beginning ends of the first and second coils wound on the first and second winding subchambers 5*b*-1 and 5*b*-2 are shortcircuited, and the winding ending ends of them are also shortcircuited. The first shield coil 4*a* thus divided and connected will produce the useful effects as of the first embodiment already described.

The operation of the thus constructed transformer will be described with reference to FIGS. 2 and 3.

When the above-mentioned transformer for the switching power supply is applied to a switching regulator, the leaking magnetic flux couples with the coil located near the center-leg air gap 6 to cause an eddy current therein in the conventional transformer. In this connection, in the transformer of the invention, the shield coils 4, not the main coil, are present at the location near the center-leg air gap 6. Therefore, the eddy current loss by the leak magnetic flux from the center-leg air gap 6, viz., the heat by the eddy current loss, is considerably reduced. Further, it is noted that the shield coils 4 wound cover the location near the center-leg air gap 6 and the abutting portions 7*a* and 7*b* of the two outer legs 7. With this feature, the heat generated in the shield coils 4 by their eddy current loss is efficiently dissipated into the air. As a result, temperature rise of the whole transformer is also suppressed. As already stated, the shield coils 4 are the first and second shield coils 4*a* and 4*b*. Of those shield coils, the first shield coil 4*a* is based on the principle diagrammatically illustrated in FIG. 6 and has a function to shield mainly the magnetic flux leaking from the air gap. The second shield coil 4*b* has a function to shield the leaking magnetic flux parallel to the main magnetic flux, viz., it serves as a substitution of the copper plate conventionally used. The shield coils 4*a* and 4*b*, and the coils 2*a* and 2*b* are wound in the bobbin through a series of steps, and connected to the bobbin terminals 9 by one step of soldering. In other words, there is eliminated the shield mounting steps, which are essential steps in the conventional transformer, whereby the manufacturing process of the transformer is simplified.

A specific example of the second embodiment of the present invention will be described with reference to the drawings.

In a transformer for switching power supply, the collars are provided on the top and bottom ends of the bobbin 3. A total of eleven chambers 5*a*-1 to 5*a*-5, 5*b*-1 and 5*b*-2, and 5*c*-1 to 5*c*-4 are located between those collars. The ferrite core 1 has a hole at the central part through which the center leg 8 is inserted. The center leg 8 includes the air gap 6 located substantially at the mid position. Thus, the ferrite core 1 of the EE type is centrally placed on the bobbin 3. The chamber 5*b* includes holes through which the outer legs 7 providing a magnetic path is inserted. The upper portions of the outer legs 7 abut against the lower portions of the same within the holes of the chamber 5*b*. The first and second subchambers 5*b*-1 and 5*b*-2, located substantially at the middle of the bobbin 3, are wound by the first and second shield coils 4*a* and 4*b*; the subchambers above the subchambers 5*b*-1 and 5*b*-2 are wound by the primary auxiliary coil 2*a*-1, secondary coil 2*a*-2, primary main coil 2*a*-3, secondary coil 2*a*-4 and primary main coil 2*a*-5; the subchambers below the subchambers 5*b*-1 and 5*b*-2 are wound by the secondary coil 2*b*-1, primary main coil 2*b*-2, secondary coil 2*b*-2 and primary main coil 2*b*-4. The coils are first wound on the subchamber 5*c*-4 closer to the bobbin terminals 9, and on the subsequent ones in successive order. The first shield coil 4*a* is wound on the second subchamber 5*b*-2, which is located substantially at the middle, by the number of turns substantially the half of the total number of turns of the first shield coil 4*a*. The first shield coil 4*a* is also wound on the first subchamber 5*b*-1 by the remaining number of turns in the winding direction opposite to that in which the shield coil 4*a* is wound on the second winding subchamber 5*b*-2. After the winding of the shield coil on the first winding subchamber 5*b*-1, the second shield coil 4*b* is wound on the second winding subchamber 5*b*-2 and collar ridge portions 10*a* and 10*b* as the upper portions of the bobbin. The terminals of those shield coils are all led to bobbin terminals 9, and soldered thereto by one step of soldering. Thus, the first-and second shield coils 4*a* and 4*b*, which are essential to the present invention, as well as other coils of the transformer may be wound in a series of manufacturing steps and soldered by one step of soldering. Therefore, the manufacturing process of the transformer is more simplified than that of the conventional transformer with the shielding function. While the present invention has been described by use of the transformer, the invention may be applied to other devices and components of great change of magnetic flux, e.g., an inductor for active filter.

Data for evaluating the shielding function of the thus constructed transformer actually installed will be given below.

Induction voltages of search coils with the shield coils and no shield coils were measured.

TABLE (3)

| Shielding effect by the first shield coil 4a | | |
|---|---|---|
| | Shield coil 4a Not used | Shield coil 4a used |
| Induction voltage (mV) | 87.2 | 60.8 (Approx. 30% Reduction) |

TABLE (4)

| Shielding effect by the first shield coil 4b | | |
|---|---|---|
| | Shield coil 4b Not used | Shield coil 4b Used |
| Induction voltage (mV) | 116.8 | 64.0 (Approx. 45% Reduction) |

TABLE (5)

| Conditions of the above measurements | |
|---|---|
| Switching power supply output | 130 W |
| Circuit | Flyback |
| Ferrite core type | EER 40 |
| Center-leg air gap | 1.22 mm |
| Shield chamber width | 4 mm |
| Shield coil diameter | 0.35 mm |

The data presented above clearly shows the following facts: provision of the shield coils at a location near the air gap successfully reduces the effects of the eddy current loss by the magnetic flux leaking through the air gap, and produces an effective shielding effect of the transformer. Therefore, it will be seen that the present invention succeeds in providing a transformer for switching power supply and an inductor for active filter, both having the advantageous features mentioned above.

As seen from the foregoing description, the present invention considerably reduces the effects of the eddy current loss caused by the magnetic flux leaking through the air gap of the core without increasing the size of the core. Further, the shield coils as well as other coils are wound through a series of winding steps and soldered to the related terminals by one step of soldering. Therefore, there is no need of mounting the copper plate or the short ring of wire by manual. The result is simplification of the manufacturing process of transformers and inductors. The shield coils are wound in the bobbin into a unit form, the fixing of the shield coils is stable.

What is claimed is:

1. An inductance device comprises:

an EE type ferrite core with an air gap at a center leg portion;

a bobbin having at least three chambers wound by coils, said ferrite core being placed on said bobbin; and a shield coil includes a first part and a second part of the coil, in which the first part is wound on a shield chamber surrounding a peripheral portion of the air gap and the second part is wound on the shield chamber in a reverse direction of the first part, the ends of the shield coil being short-circuited.

2. The inductance device according to claim 1, wherein said chamber surrounding the peripheral portion of the air gap includes a projecting portion to divide into two subchambers, and the first part of the shield coil is wound on one of the subchamber while the second part is wound on the other.

3. The inductance device according to claim 1, further comprising a terminal formed in said bobbin to which both ends of said shield coil are connected.

4. The inductance device according to claim 1, wherein number of turns of the first part of the shield coil is equal to that of the second part.

5. The inductance device according to claim 1, herein said chamber surrounding the peripheral portion of the air gap includes a central hole for receiving the center leg of said ferrite core and holes for receiving outer legs of said ferrite core.

6. The inductance device according to claim 5, wherein said chamber surrounding the peripheral portion of the air gap includes a projecting portion to divide into two subchambers, and the first part of the shield coil is wound on one of the subchamber while the second part is wound on the other.

7. The inductance device according to claim 6, further comprising a terminal formed in said bobbin to which both ends of said shield coil are connected.

8. The inductance device according to claim 5, further comprising a second shield coil which has a portion winding in a direction perpendicular to the chamber surrounding a peripheral portion of the air gap, both ends of the second shield coil being short-circuited.

9. The inductance device according to claim 8, further comprising a second terminal formed in said bobbin to which both ends of said second shield coil are connected.

10. The inductance device according to claim 6, further comprising a second shield coil which has a portion winding in a direction perpendicular to the chamber surrounding a peripheral portion of the air gap, both ends of the second shield coil being short-circuited.

11. The inductance device according to claim 10, further comprising a second terminal formed in said bobbin to which both ends of said second shield coil are connected.

* * * * *